US008268105B2

(12) United States Patent
Bernacchi

(10) Patent No.: US 8,268,105 B2
(45) Date of Patent: Sep. 18, 2012

(54) METHOD AND AN APPARATUS FOR PRODUCING EXAM TABLE PAPER ROLLS

(76) Inventor: Andrea Bernacchi, Antraccoli (IT)

( * ) Notice: Subject to any disclaimer, the term of this patent is extended or adjusted under 35 U.S.C. 154(b) by 572 days.

(21) Appl. No.: 12/374,812

(22) PCT Filed: Jul. 25, 2007

(86) PCT No.: PCT/IB2007/002107

§ 371 (c)(1),
(2), (4) Date: Jan. 23, 2009

(87) PCT Pub. No.: WO2008/012647

PCT Pub. Date: Jan. 31, 2008

(65) Prior Publication Data

US 2010/0139849 A1 Jun. 10, 2010

(30) Foreign Application Priority Data

Jul. 25, 2006 (IT) ..... BO2006A0553

(51) Int. Cl.
*B31F 1/07* (2006.01)

(52) U.S. Cl. ..... 156/209

(58) Field of Classification Search ..... None
See application file for complete search history.

(56) References Cited

U.S. PATENT DOCUMENTS 5,339,730 A 8/1994 Ruppel et al.
5,851,352 A * 12/1998 Vinson et al. ..... 162/112
6,755,928 B1 * 6/2004 Biagiotti ..... 156/209
2001/0008179 A1 * 7/2001 Oriarian et al. ..... 162/109
2005/0053644 A1 * 3/2005 Salemi et al. ..... 424/443
2005/0079332 A1 * 4/2005 Bauer et al. ..... 428/211.1
2006/0243383 A1 * 11/2006 Gelli et al. ..... 156/291

FOREIGN PATENT DOCUMENTS

EP 0905318 A 3/1999
WO WO01/47699 A 7/2001
WO WO 2005077649 A1 * 8/2005

OTHER PUBLICATIONS

International Search Report.

* cited by examiner

*Primary Examiner* — John L. Goff
*Assistant Examiner* — Barbara J. Musser
(74) *Attorney, Agent, or Firm* — William J. Sapone; Coleman Sudole Sapone P.C.

(57) ABSTRACT

A method relates to the production of paper rolls for examination tables, obtained from a tape (100) of embossed paper, having two layers (10, 20), joined together. The band (100) is obtained in known way from two continuous webs (1, 2), subjected to subsequent steps of embossing, glue (C) application, coupling and stabilization. The method includes applying measured quantities of a sanitizing and/or disinfectant substance (S) between the two layers of embossed paper (10, 20) before their joining; preferably, the substance (S) is applied to the same continuous web (1) that is aimed at receiving the glue (C), after the embossing step and contemporarily with the glue (C) application, by spot-application of a mixture (M) in aqueous solution containing suitable percentage of the glue (C) and sanitizing substance (S) to the tops (11A) of the embossing relieves (11.) In this case, the application means (240) for sanitizing substance (S) are formed by the same means (220) for applying the glue (C).

1 Claim, 3 Drawing Sheets

METHOD AND AN APPARATUS FOR PRODUCING EXAM TABLE PAPER ROLLS

TECHNICAL FIELD OF THE INVENTION

The invention relates to the technical field concerning the production of disposable paper articles, such as e.g. tablecloths, napkins, wash-clothes, towels and the like.

In particular, the invention relates to paper in rolls for obtaining disposable sheets, used for examination tables in medical surgeries.

The paper used for this purpose is usually of "tissue" type, double-layered and embossed.

PRIOR ART IN THE INVENTION FIELD

As it is known, the embossing is a permanent deformation made on an originally smooth web of paper by suitable embossing rolls, so as to obtain relieves, arranged according to a prefixed weft or a prefixed pattern, which make the webs crinkled.

Afterwards, glue spots are applied to one of the webs, on the top of the embossing relieves, by an application roll, acting tangential to the embossing roll, counter-rotating with respect thereto and with suitable adjustment.

Then, the two webs, which are to form the two layers, are coupled in accordance with a predetermined pattern, according to which the glue spots of the first web can meet, e.g. the tops of the second web relieves or its hollows.

According to a known technique, the glue used for this operation is an aqueous solution, which dries rapidly and, if necessary, can be mixed with coloring substances; in the last case, color spots, aimed at coloring the article surface, are obtained in points corresponding to the glue spots.

Obviously, in case of food articles and the like it is necessary to use suitable principle for choosing the kind of paper, glue and, if needed, ink, so that the obtained products are anallergic, non-toxic and whatever required by the regulatory standards.

In case of the above mentioned webs, considered their use delicacy, it is very important to offer also good hygiene and aseptic characteristics, besides the above mentioned requirements, for bigger patient's protection.

However, from this point of view, the rolls for the sheet of known type cannot ensure safety much more than other articles for food use; at most, environment conditions during the production can be improved and/or more restrictive measures can be used for the machine parts touching the paper.

SUMMARY OF THE INVENTION

Therefore, the object of the present invention is to propose a method for producing exam table paper rolls, in which the used paper is more aseptic, due to the application of a suitable sanitizing substance, aimed at passing its properties to the paper layers and at ensuring its effect for a sufficiently long time.

Another object of the invention is to propose an apparatus, which carries out the above mentioned method, by applying measured quantities of sanitizing substance between the two layers of embossed paper, before their joining.

A further object of the invention is to propose an apparatus, which is capable of carrying out said method with production costs and time analogous to those necessary for the corresponding products of known type.

The above mentioned objects are fully obtained by a method and by a corresponding apparatus for producing rolls of tissue paper for examining tables, obtained with a band of embossed paper having two joined layers, said band being obtained from two continuous webs subjected to subsequent steps of embossing, glue application, joining and stabilizing, and with said method including also the application of measured quantities of sanitizing substance between the two layers of embossed paper before their joining.

BRIEF DESCRIPTION OF DRAWINGS

The characteristic features of the proposed method will become more evident from the following description of some preferred embodiments of the apparatus that carries it out, in accordance with the contents of the claims and with the help of the enclosed figures, in which:

DETAILED DESCRIPTION OF THE INVENTION

Figure 2:
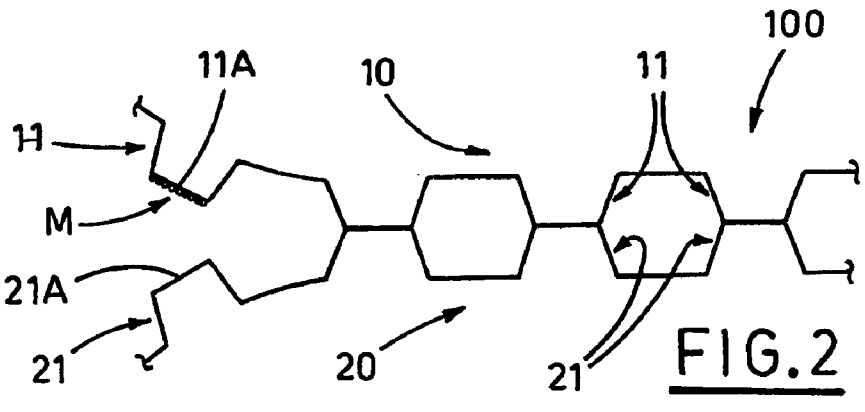
FIGS. 2 and 3 are enlarged views of two possible ways of joining the two layers of embossed paper, according to what has been obtained with the apparatus of FIG. 1.

Regarding the above mentioned Figures, the reference numeral 100 indicates an embossed paper band having two layers 10, 20, joined together, aimed at being rolled up in rolls (not shown), from which a plurality of disposable sheets are obtained to be used in medical surgeries.

According to a known technique, the band 100 is obtained from two continuous webs 1, 2, subjected to subsequent steps of embossing, glue C application, coupling and stabilization.

The above mentioned work steps are performed by a known apparatus 200, which includes first rollers 201, 202 for feeding the two continuous webs 1, 2, aimed at forming the layers 10, 20; second rollers 211, 212 for embossing the webs 1, 2; at least one third roller 220 for applying a glue C between the layers 10, 20; and a fourth roller 230, cooperating e.g. with one of said embossing rollers 211, 212 in coupling and stabilizing the layers 10, 20.

The used glue C, as already said in the introductory note, is an aqueous solution, which dries rapidly and which, if necessary, can be mixed with coloring substances.

The method proposed by the present invention includes applying measured quantities of a sanitizing-disinfectant substance S between the two layers of embossed paper 10, 20, before their joining.

Also the sanitizing-disinfectant substance S is an aqueous solution, which dries rapidly and which contains active agents aimed at giving disinfectant and antiseptic features; moreover, the sanitizing-disinfectant substance S releases gradually the active agent, so that its sanitizing action can be spread beyond the application areas, maintaining its characteristics for a reasonably long time, longer than the medium time passing between the production and use of the rolls. Different substances having the above described characteristics are known in many medical uses.

In order to carry out the method, the apparatus 200 includes application means 240, situated upstream of the fourth coupling roller 230 and aimed at applying measured quantities of said sanitizing substance S on at least one of said layers 10, 20, on the side turned toward the other layer.

According to a preferred embodiment of the method, the sanitizing substance S is applied to the same continuous web 1 that is aimed at receiving the glue C, after the embossing step and contemporarily with the glue C application; a mixture M in aqueous solution containing suitable percentage of glue C and sanitizing substance S is spot-applied to the tops 11A of the embossing relieves 11.

Figure 1:
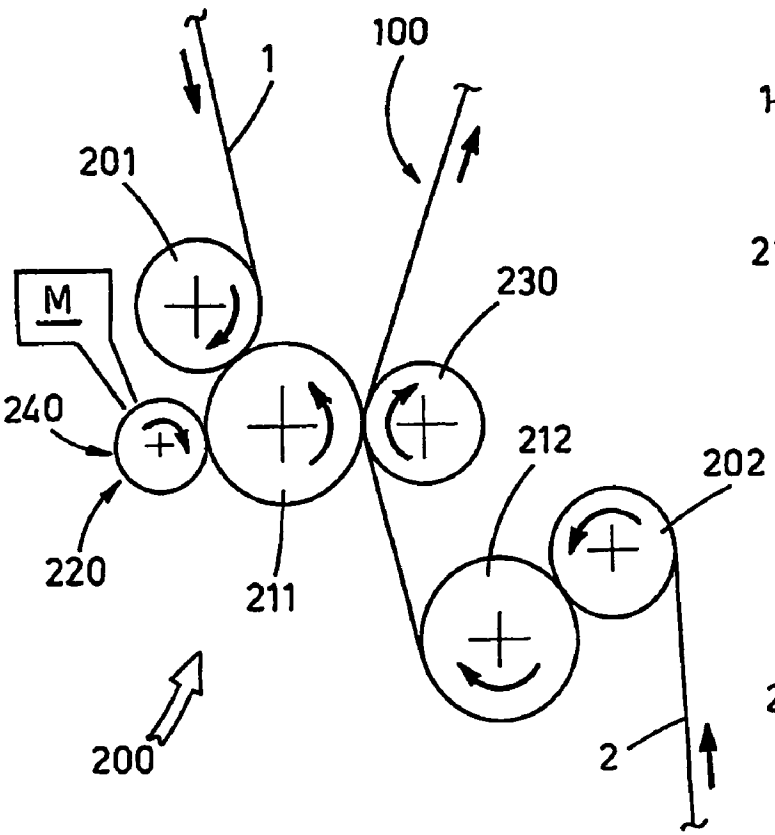
FIG. 1 is a schematic, lateral view of the apparatus according to a first embodiment.

In this case, the application means 240 for sanitizing substance S are formed by the same third roller 220 for applying the glue C (FIG. 1).

FIG. 2 shows a first possible coupling pattern between the two layers 10, 20, in which the tops 11A of the first layer 10, with spots of said mixture M applied thereto, meet the aligned tops 21A of the embossing relieves 21 of the second layer 20.

Figure 3:
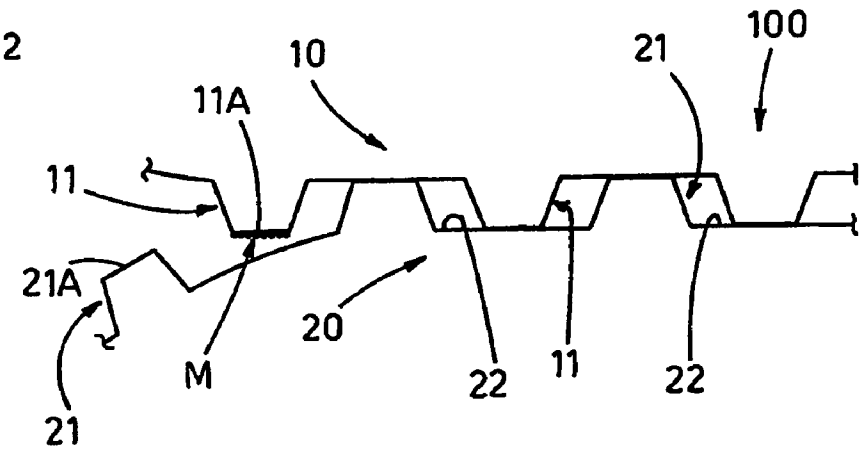

FIG. 3 shows a second possible coupling pattern between the two layers 10, 20, in which the tops 11A of the first layer 10, with spots of said mixture M applied thereto, are offset with respect to the tops 21A of the embossing relieves 21 of the second layer 20 and meet the hollows 22 of the latter.

The application of the sanitizing-disinfectant substance S to the tops 11A of the embossing relieves 11 of the web 1, shown in FIGS. 2 and 3, can be obtained also by two variants of said preferred embodiment of the method:

according to the first variant, the application is performed after the embossing step and before said glue C application step, by spot-applying of aqueous solution containing only the sanitizing substance S;

according to the second variant, the application is performed after the embossing step and the glue C application step, likewise by spot-applying of aqueous solution containing only the sanitizing substance S.

Figure 4:
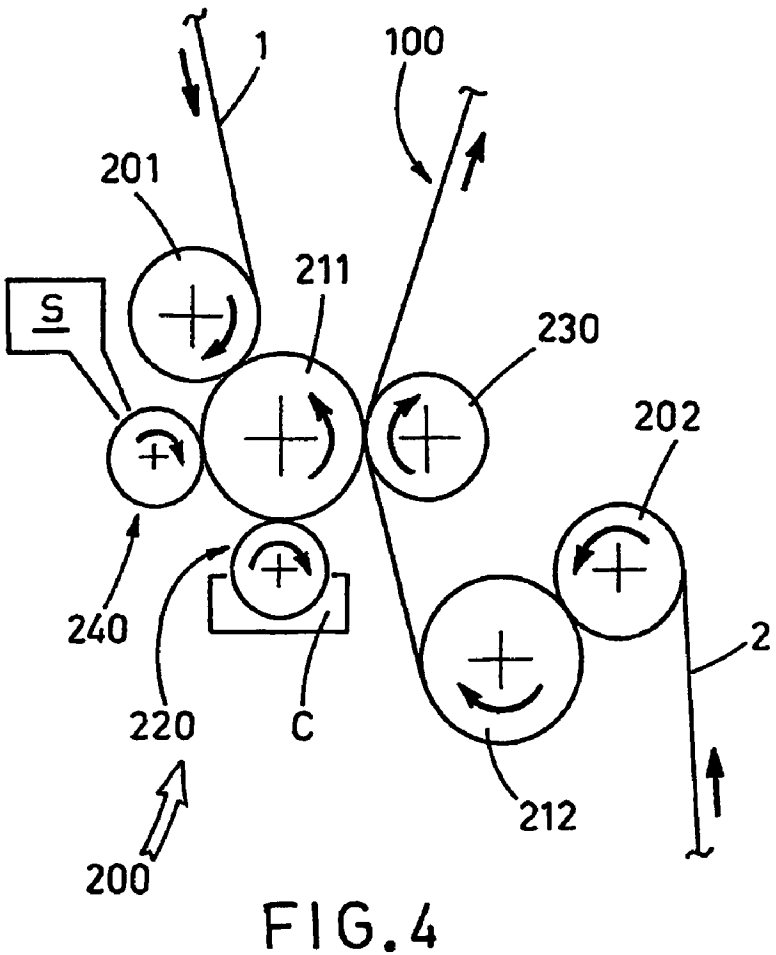
FIG. 4 shows a version of the apparatus of FIG. 1, which obtains the same results as FIGS. 2 and 3.

The realization of the above variants requires application means 240 separated from the third roller 220 for the glue C in the apparatus 200; FIG. 4 shows the layout related to the first variant, in which the application means 240, formed e.g. by a relative roller tangential to the embossing roller 211, are situated upstream of the third roller 220, while for the second above mentioned variant it is obviously necessary to invert the positions.

According to a second embodiment of the method, the sanitizing substance S is applied to the continuous web 2 that is opposite to the one aimed at receiving the glue C, after the embossing step, by spot-application of an aqueous solution to the tops 21A of the embossing relieves 21.

Figure 5:
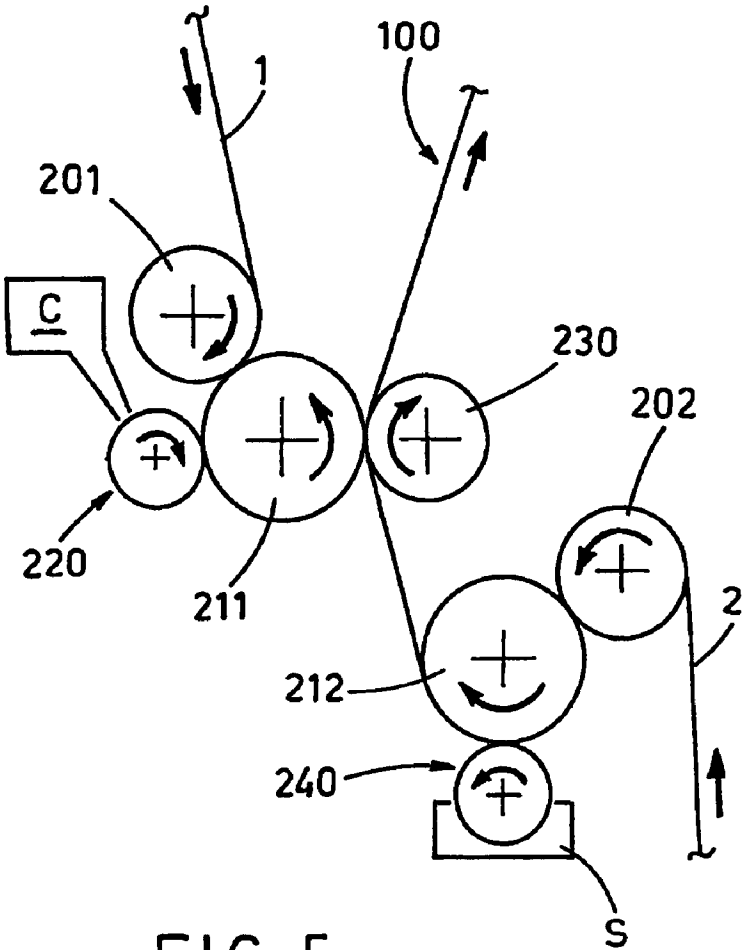
FIG. 5 is a schematic, lateral view of the apparatus according to a second embodiment.

Said second embodiment is realized with the application means 240, including e.g. a relative roller, arranged tangential to the corresponding embossing roller 212 (FIG. 5).

Figure 6:
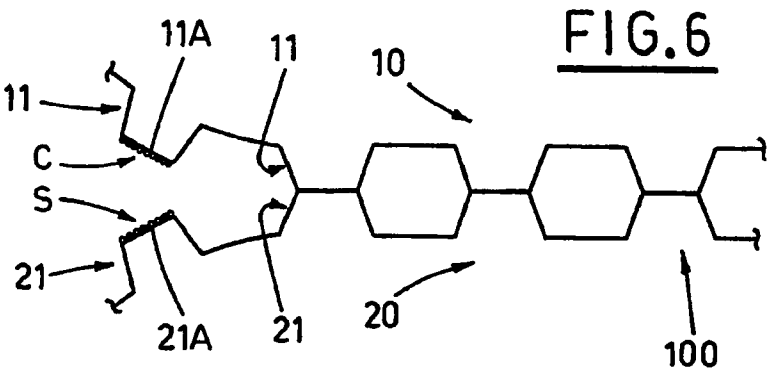
FIG. 6 shows, in the same view as in FIG. 2, the results obtained by the apparatus of FIG. 5.

FIG. 6 shows the same coupling pattern between the two layers 10, 20 of FIG. 2, in which the tops 11A of the relieves 11 of the first layer 10, with glue-spots C applied thereto, meet the aligned tops 21A of the embossing relieves 21 of the second layer 20 with the sanitizing substance S spot-applied thereto; the previously described mixture M of glue C and substance S is recomposed due to the joining of the two layers 10, 20.

According to a third embodiment of the method, the sanitizing substance S is applied to one of the continuous webs 1, 2 before the embossing step, in a film of aqueous solution placed onto the smooth surface of said continuous web 1 or 2.

Otherwise, the above film of the sanitizing substance S can be applied by printing techniques or spray techniques.

Figure 7:
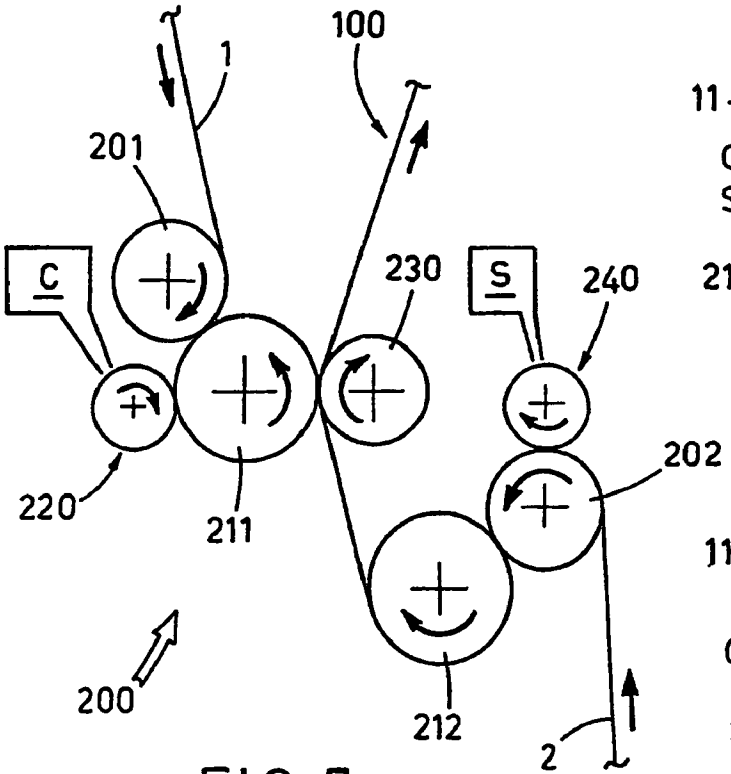
FIG. 7 is a schematic, lateral view of the apparatus according to a third embodiment.

Said third embodiment is realized with the application means 240, including e.g. a relative roller, or spraying nozzles, arranged upstream of the embossing roller 211 or 212, respectively for the continuous web 1 or 2; according to the solution shown in FIG. 7, relative to the continuous web 2, the application roller 240 is arranged tangential with respect to the feeding roller 202.

According to the configuration regarding the continuous web 1, not shown, the roller 240 is situated tangential to the corresponding feeding roller 201.

Figure 8:
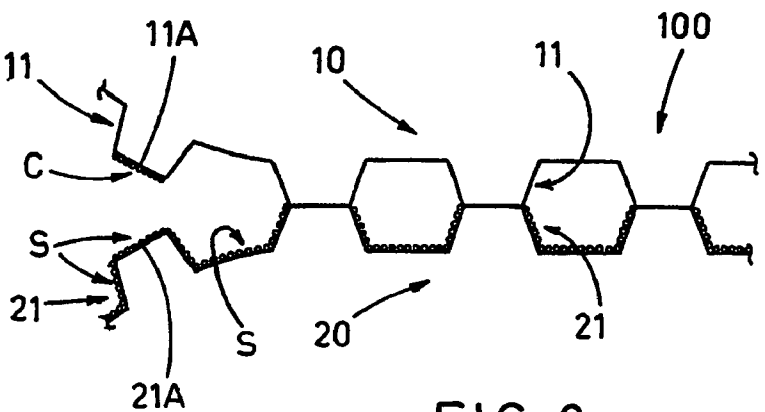
FIG. 8 shows, in the same view as in FIGS. 2 and 6, the results obtained by the apparatus of FIG. 7.

FIG. 8 shows the same coupling scheme between the two layers 10, 20 of FIGS. 2 and 6, in relation to the apparatus configuration of FIG. 7; in this case, the tops 11A of the relieves 11 of the first layer 10, with glue-spots C applied thereto, meet the aligned tops 21A of the embossing relieves 21 of the second layer 20 with the film of the sanitizing substance S applied thereto.

It is intuitive to understand that, according to the last embodiment of the method, a bigger quantity of sanitizing substance S is applied, which obviously has stronger sanitizing effects on the layers 10, 20 of embossed paper.

The advantages that the proposed method allows to obtain with respect to the prior art products appear extremely obvious from what has been said above. The proposed method offers high hygienic and aseptic features of the rolls, and of the sheets obtained from the latter, for improved patient's care.

Another important advantage lies in the fact that the apparatus that carries out the method, in all the described embodiments, is substantially identical with the known ones, in the costs terms, as well as in the production speed terms; practically, the only cost increase with respect to the known solutions results from the use of the sanitizing substance.

Consequently, the proposed method in its simplicity allows to offer a product with high quality characteristics, obtained with an insignificant cost increase, which makes it possible to offer it also for articles different than the sheets, such as napkins, handkerchiefs, wash-clothes and others.

However, it is understood that what above is a not limiting example, therefore possible changes of detail, applied to the method steps and/or apparatus, are considered within the protection scope of the claims below.

The invention claimed is:

1. A method for producing rolls of sanitizing paper having an active sanitizing substance therein for use on examination tables, the method comprising:

providing two continuous webs;

embossing the two continuous webs to form two embossed layers;

providing a mixture containing glue and a sanitizing substance in an aqueous solution, the mixture containing an amount of the sanitizing substance therein effective for providing a sanitizing action in the sanitizing paper;

applying the mixture between the two layers (10, 20) of embossed paper before their joining, the mixture being applied to at least one of said embossed layers (1, 2), on a side facing the other embossed layer, the mixture applied in a spot-application to tops (11A) of embossing relieves (11) formed in the embossed layer, the amount of sanitizing substance applied with the mixture being sufficient to spread the sanitizing action beyond the application areas while containing sufficient glue to bond the embossed layers together; and, joining the two embossed layers together and stabilizing the joined layers to provide a band (100) of sanitizing paper.

* * * * *